US005233891A

United States Patent [19]

Arnold et al.

[11] Patent Number: 5,233,891

[45] Date of Patent: Aug. 10, 1993

[54] DETENT MEANS

[75] Inventors: Robert L. Arnold, Leola; Kenneth J. Taggart, Columbia, both of Pa.

[73] Assignee: Easco Hand Tools, Inc., Lancaster, Pa.

[21] Appl. No.: 755,783

[22] Filed: Sep. 6, 1991

[51] Int. Cl.[5] ..... B25B 13/46

[52] U.S. Cl. ..... 81/60; 81/63.2; 81/177.85

[58] Field of Search ..... 81/60, 61, 62, 63, 63.1, 81/63.2, 177.85; 24/616, 590, 456; 279/79, 76; 74/527

[56] References Cited

U.S. PATENT DOCUMENTS

| | | | |
|---|---|---|---|
| 376,584 | 1/1888 | Cone . | |
| 1,135,929 | 4/1915 | Sands | 81/63 |
| 1,140,167 | 5/1915 | Kolb et al. . | |
| 1,364,242 | 1/1921 | Butler | 81/63 |
| 2,852,874 | 9/1958 | Grubb | 279/79 X |
| 3,092,374 | 6/1963 | Krekeler | 279/79 X |
| 3,127,799 | 4/1964 | Bergquist | 81/63.1 X |
| 3,490,317 | 1/1970 | Rozmus | 81/62 |
| 3,587,457 | 6/1971 | Morris | 101/110 |
| 3,777,596 | 12/1973 | Smyers, Jr. et al. | 81/177 G |

*Primary Examiner*—D. S. Meislin
*Attorney, Agent, or Firm*—Leonard Bloom

[57] ABSTRACT

A one-piece detent for mounting in a bore, the detent including a foot, a head and a resilient connecting member therebetween. The foot is disposed against a stop in the bore and the connecting member urges the second end outwardly from the bore. The connecting member provides a resiliency when a force is applied against the head of the detent, such that the connecting member is partially collapsed in the bore.

16 Claims, 15 Drawing Sheets

DETENT MEANS

FIELD OF THE INVENTION

The following invention relates to detent means and in particular to detent means to releasably hold a component to a ratchet wrench and the like.

BACKGROUND OF THE INVENTION

A detent is a means of locking or unlocking a movement and detents have been widely used in diverse applications including machinery, tools and consumer products.

Resilient engaging means which include rubber-like bodies or blocks have been disclosed in the following:

| U.S. Pat. No. | Issued | Inventor(s) |
|---|---|---|
| 3,092,374 | 06/04/63 | Kreheler |
| 3,127,153 | 03/31/64 | Elders |
| 3,177,037 | 04/06/65 | Elders |
| 3,254,922 | 06/07/66 | Kreheler. |

A resilient wire spring to hold a screwdriver bit in a handle as disclosed in U.S. Pat. No. 2,483,563 issued to Rock is another type of detent means. U.S. Pat. No. 4,649,712 issued to Tate, Jr. et al discloses a spring clip for use in a thermostat. A detent means comprising a pin with a C-shaped spring attached to the head of the pin is disclosed in U.S. Pat. No. 3,587,457 issued to Morris. The C-shaped head serves as a spring to urge the pin to engage a notch in a wheel which encircles the detent means. These types of detents represent a less commonly used type of detent means.

The detent means used in tools are of a different type and are well known: Many applications of detents means for engaging a pawl in a ratchet wrench or in holding a socket to a ratchet wrench have been reported.

U.S. Pat. No. 4,781,085 issued to Fox, III, discloses a ball disposed in a radial cavity, the ball being moved by a spring activated locking bolt. Numerous other detent means have been disclosed for ratchet wrenches and other tool applications.

However, all of these detent means in tools comprise a spring which is disposed in a bore or in a retaining clip and a separate ball, plunger or pin which is in contact with and urged by the spring. The use of this type of detent means requires a preassembly process or a manual operation to assemble the spring and detent in the appropriate portion of the tool. The assembly further requires special tooling to facilitate loading of the detent means when the spring pressure is released against the detent means or else requires man hours to complete the assembly. Such operations become very expensive and labor intensive in the mass production of significant quantities of tools.

A further, and very serious, problem with the ball and spring detent means occurs during assembly and disassembly of tools in the manufacturing process or in the repairs/servicing procedures. To place the ball and spring detent means in the bore, the ball, which usually has a diameter of 5 mm or less, is balanced on the top of the spring using a pair of tweezers. The combination is then carefully inserted into the bore and the spring is compressed while still balancing the ball on the top. In the case of a detent means used with a pawl, a special wire type tool is used to keep the spring compressed while the pawl is slid over the detent means so that the spring can be maintained in the compressed mode while the special tool is removed. This is a tedious job which requires training and experience on the part of the assembly person. When disassembling a tool for repair, it is very difficult to prevent the compressed spring from violently ejecting the ball. There is a serious problem with facial and eye injuries due to the force with which the ball is expelled from the tool. This injury problem is compounded because of the dirt and grease which is usually associated with the detent means in a tool which has been used to a point where repair is needed. Also, frequently the ball is lost and time is consumed searching for the ball so that it will not be a hazard for persons walking in the work area. In addition, the ball and/or spring must be replaced, adding to the cost of the repair or assembly.

Thus, despite the use of detent means for many years, the above stated problems continue to exist and there remains a need for a single piece detent means for which no assembly is required and which can be used in existing tools.

SUMMARY OF THE INVENTION

Accordingly, it is a primary object of the present invention to alleviate the problems of the prior art by providing a one-piece detent means which requires no assembly and is easily used in existing tools.

It is another object of the present invention to provide a detent means which is inexpensive and durable.

It is still another object of the present invention to provide a detent means which can be used in a wide variety of applications and which, due to its simplicity of design, can significantly reduce labor costs in assembly of devices.

In accordance with the broad teachings of the present invention, there is herein illustrated and described a detent means for mounting in a bore formed in one member, the detent means being used in joining or releasing another member to the one member, the detent means being one piece comprising a foot, a head and a resilient connecting member therebetween. The foot may be disposed against a stop means. The connecting member urges the head outwardly from the bore, the connecting member providing a resiliency when a force is applied against the head of the detent means. In a preferred embodiment the connecting means is a shaft having a first side connected to the foot of the detent means, a second side connected to the head of the detent means and at least one bight portion providing the inherent resiliency between the foot and the head. The detent means may be fabricated from a polymeric material. Preferably, the foot of the detent means is substantially flat and the head of the detent means is substantially hemispherically shaped.

In further accordance with the teachings of the present invention, there is disclosed a combination of a ratchet wrench having a handle including a head portion provided with a bore and further including a pawl adjacent to the bore. The pawl is movable between at least two detented positions, the pawl having at least two pocket means formed therein to define the two detented positions. The improvement comprises an integrally-molded unitary detent member received within the bore and projecting partially therefrom for engagement with one of the pocket means in the pawl. The unitary detent member has a sufficient degree of inherent resiliency to maintain the unitary detent member in one of the pocket means. The unitary detent member is partially collapsed within the bore as the pawl is moved from one of its detented positions to another. In this manner the use of a separate spring and detent ball are avoided, thereby substantially simplifying the assembly and servicing of the ratchet wrench.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

FIG. 1 shows the detent means of the present invention in a bore in one member.

FIG. 2 shows the detent means of the present invention, the detent means being compressed as the second member exerts a force on the head of the detent means.

FIG. 3 shows the detent means of the present invention joining the two members.

FIGS. 14A-14D are side views and FIG. 14E is a top view.

FIG. 15A is a top view and FIGS. 15B-15C are side views.

FIGS. 16 16A-16G are a sequence of cross-section views of the prior art showing placement of the spring and ball detent means in the bore.

DESCRIPTION OF THE PREFERRED EMBODIMENTS

Figure 1:
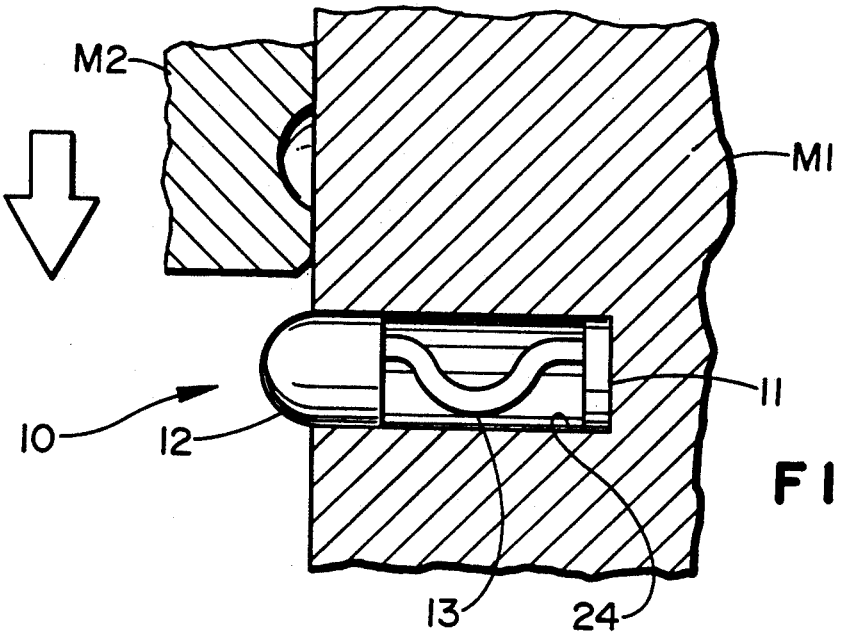
FIGS. 1-3 are side views in partial cross-section showing the detent means of the present invention in a sequence as two members are joined.
Figure 2:
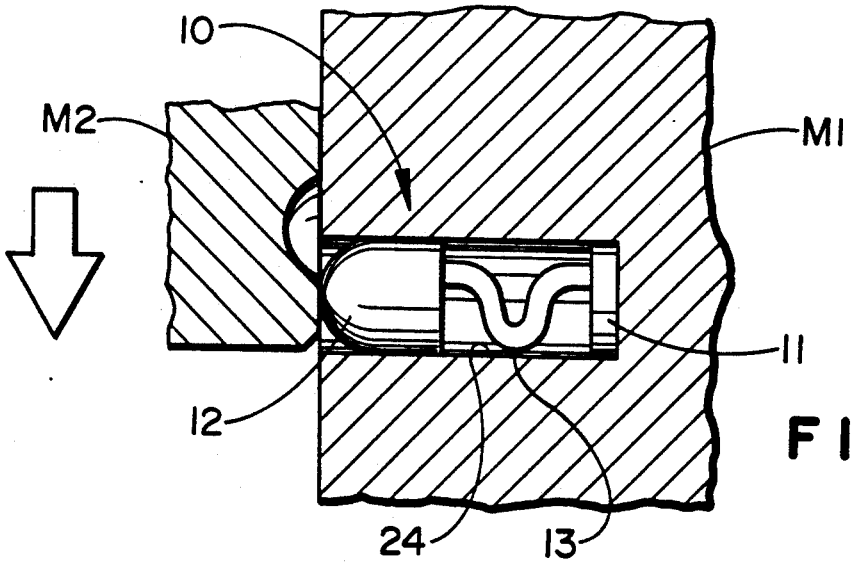
Figure 3:
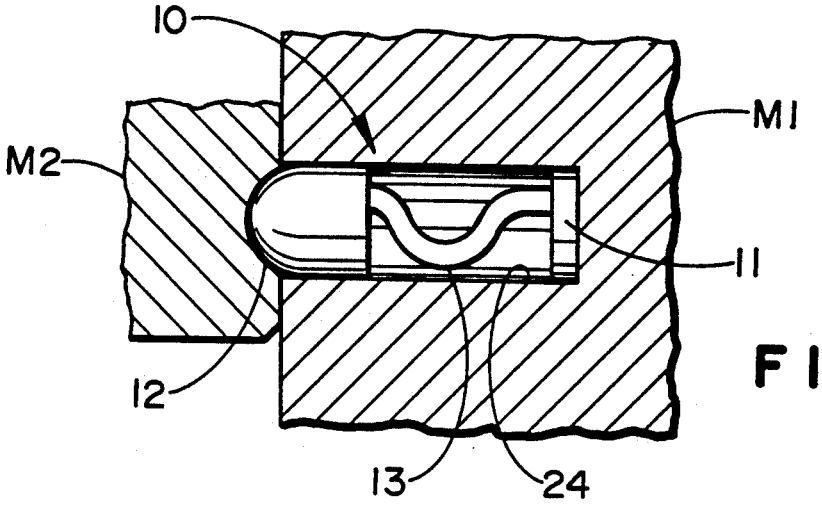
Figure 4:
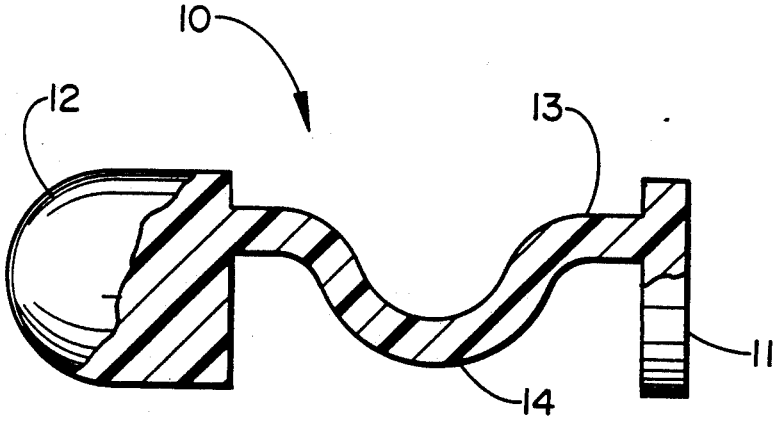
FIG. 4 is a side view, in partial cross section, of the detent means of the present invention.
Figure 6:
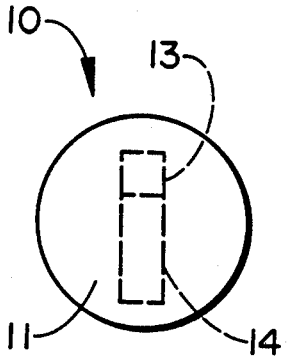
FIG. 6 is an end view of the detent means of the present invention.
Figure 5:
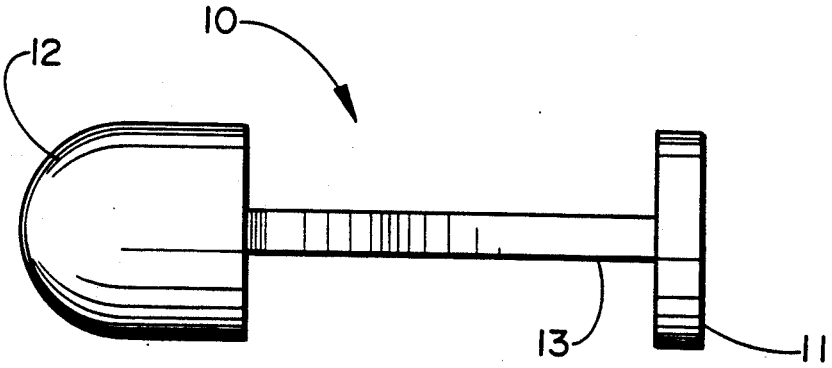
FIG. 5 is a top plan view of the detent means of the present invention.
Figure 7:
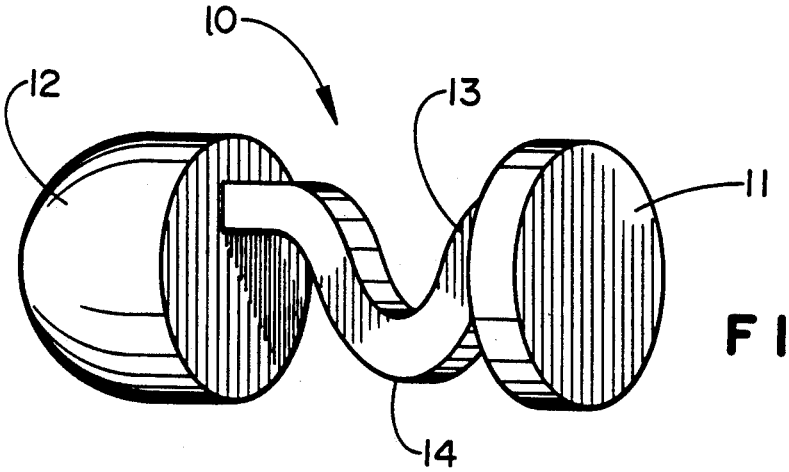
FIG. 7 is a perspective view of the detent means of the present invention.

Referring now to FIGS. 1-7, the one-piece detent means 10 of the present invention includes a foot (first end) 11 and a head (second end) 12. A resilient connecting member 13 between the foot 11 and the head 12 has at least one bight portion 14 formed thereon. The foot 11, in a preferred embodiment, has a substantially flat surface which may be disposed against a stop means to retain the detent means 10 in a desired position. The head 12, preferably, is substantially hemispherical in shape. In this manner, when the detent means 10 is disposed in a bore 24 in first member M1 of a tool with the foot 11 of the detent means 10 received in the bore 24, the connecting member 13 urges the head 12 of the detent means 10 outwardly from the bore 24. When force is applied against the head 12 of the detent means 10 by a second member M2 such as the action of a pawl P or the joining/removal of a socket S with respect to a tang T on the tool, the resiliency of the connecting member 13 permits the head 12 of the detent means 10 to be retracted within the bore and to permit movement of the pawl P or socket S. The bight portion 14 of the connecting member 13 provides the required inherent resiliency. The detent means 10 is fabricated, preferably, from a polymeric material having superior wear resistance and resiliency. Also the polymeric material may be moldable to reduce costs in production of quantities of the detent means 10. DELRIN®, a polymer provided by DuPont has been used satisfactorily in fabrication of the detent means 10. Initial prototypes of the detent means 10 have been tested in over 2,000,000 cycles and no measurable change in resiliency of the connecting member 13 or wear on the head 12 has been found.

Figure 8:
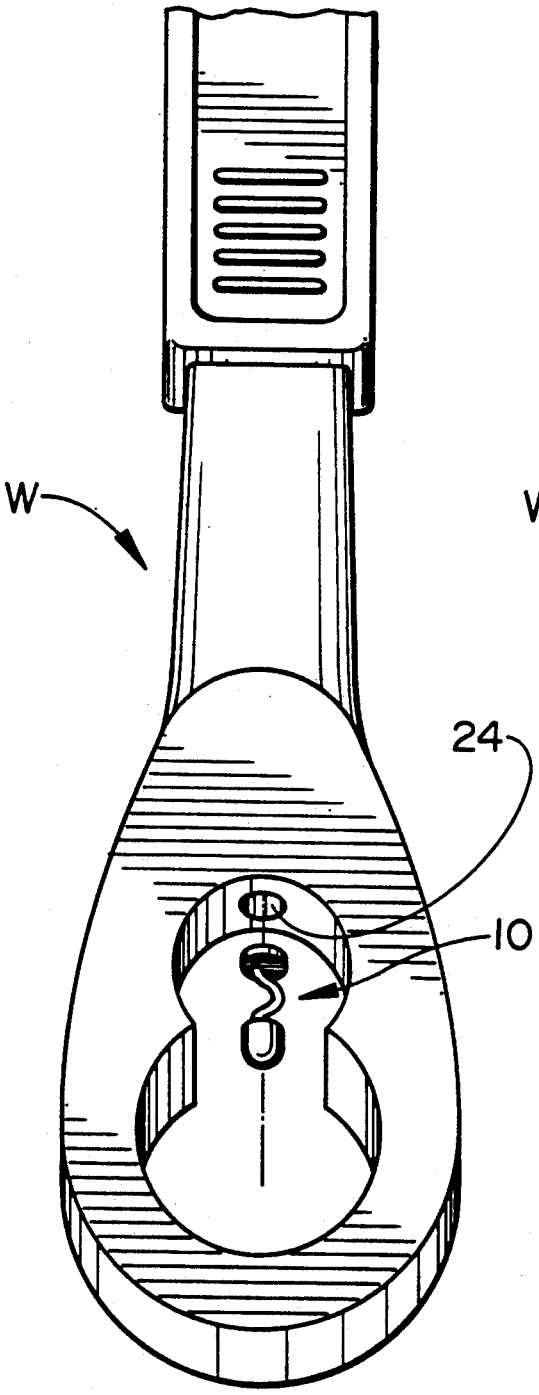
FIG. 8 is a perspective view showing the detent means of the present invention with respect to disposition in the body of a ratchet wrench.
Figure 9:
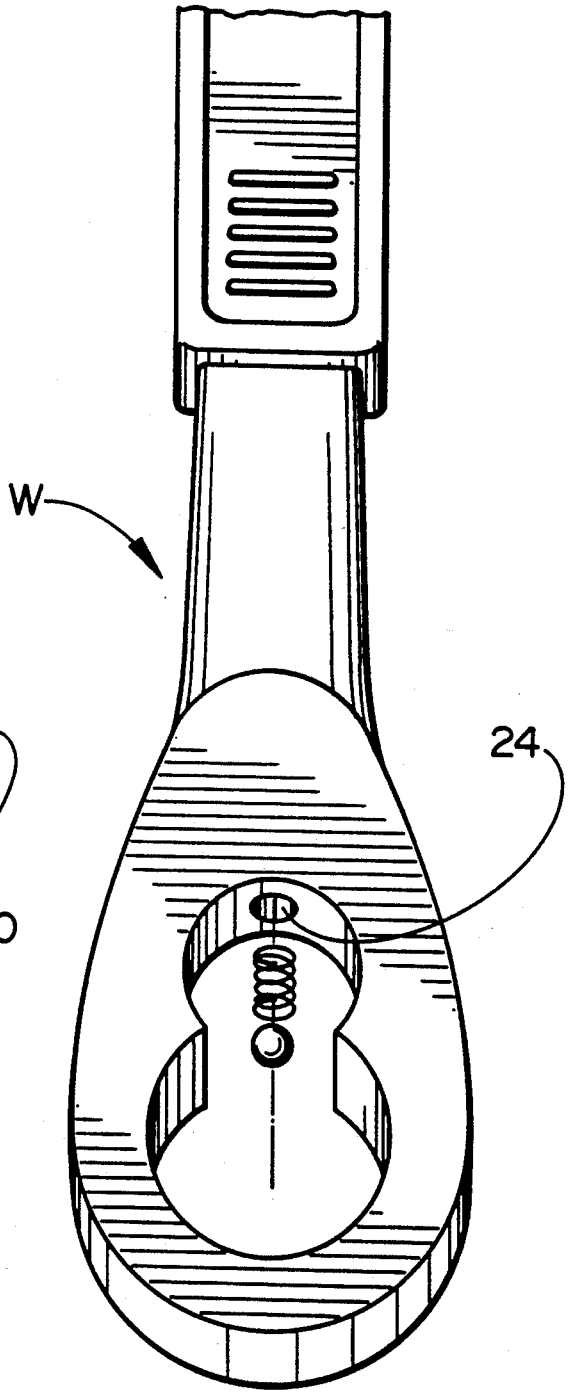
FIG. 9 PRIOR ART
FIG. 9 is a perspective view showing detent means of the prior art with respect to disposition in the body of a ratchet wrench.
Figure 10:
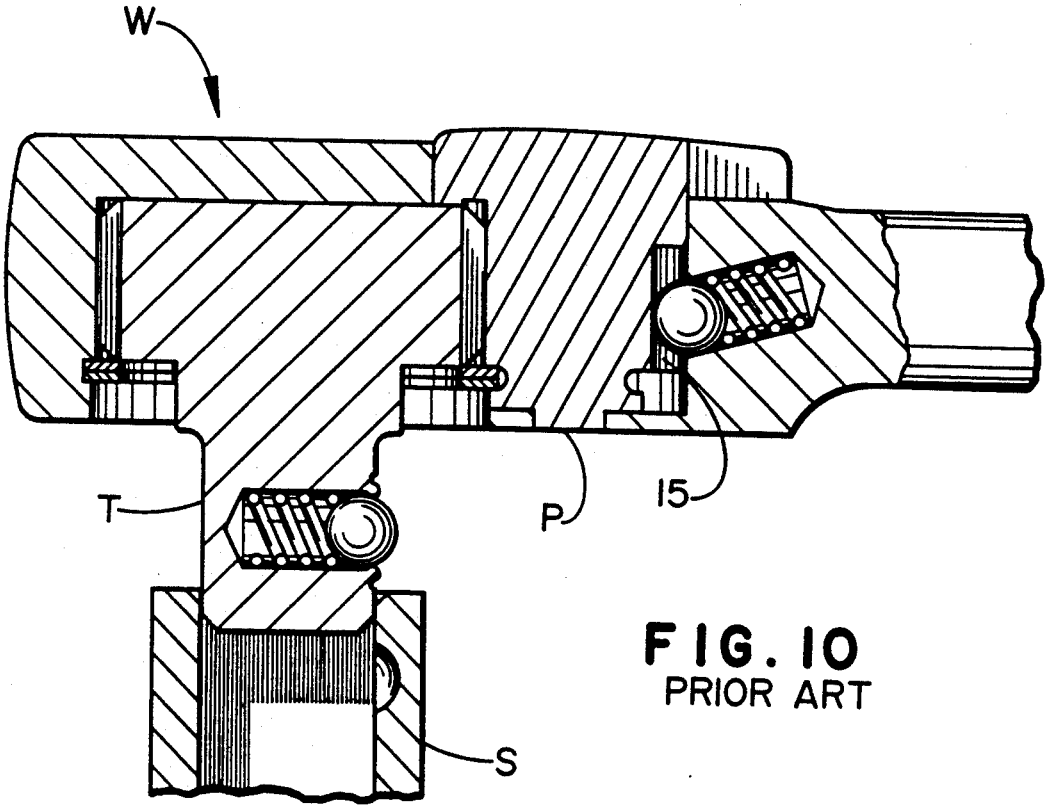
FIG. 10 PRIOR ART
FIG. 10 is a cross section view showing the detent means of the prior art disposed in the body of a ratchet wrench to engage the pawl and the socket.
Figure 11:
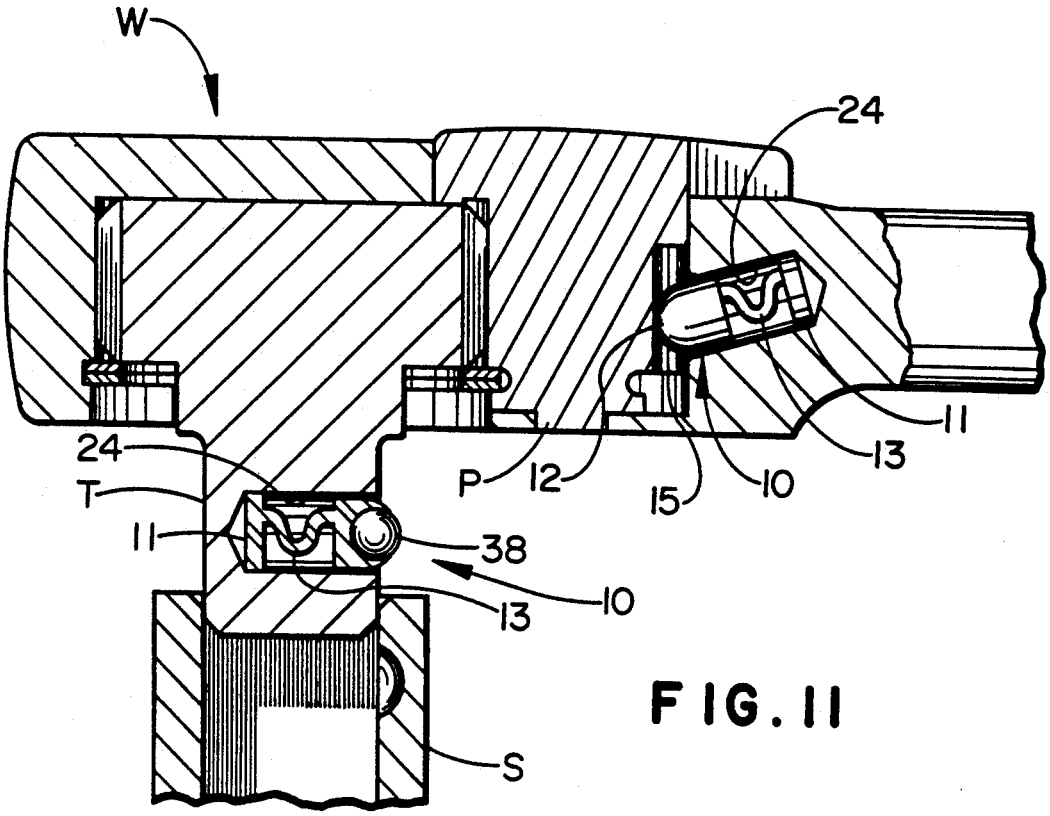
FIG. 11 is a cross section view showing the detent means of the present invention disposed in the body of a ratchet wrench to engage the pawl and the socket.
Figure 12:
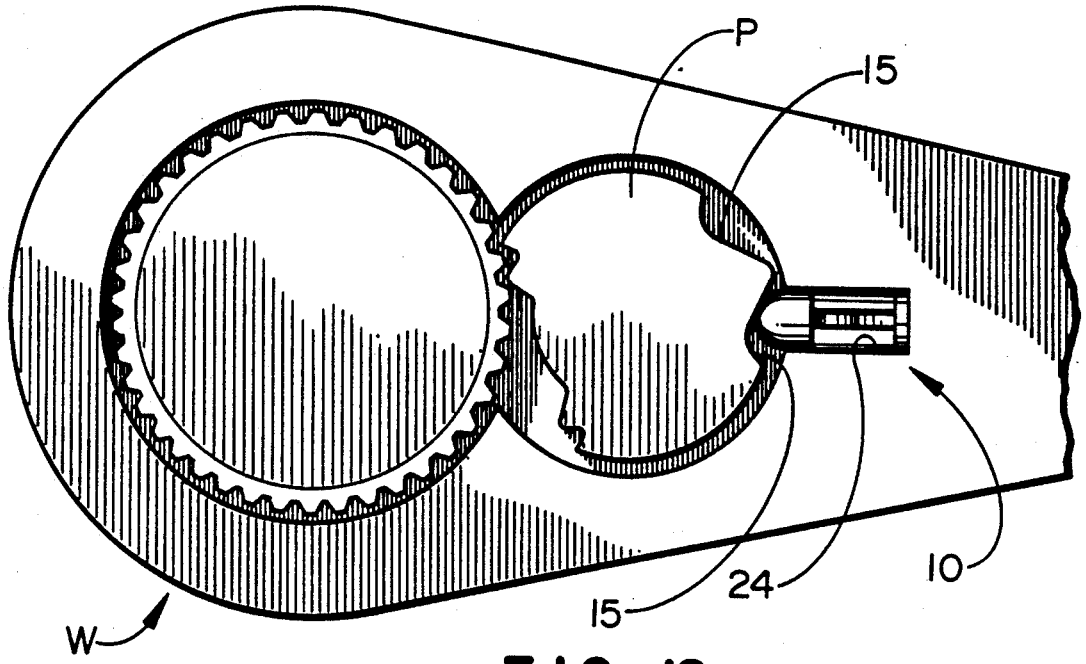
FIG. 12 is a top plan view showing the detent means of the present invention engaging one pocket in the pawl.
Figure 13:
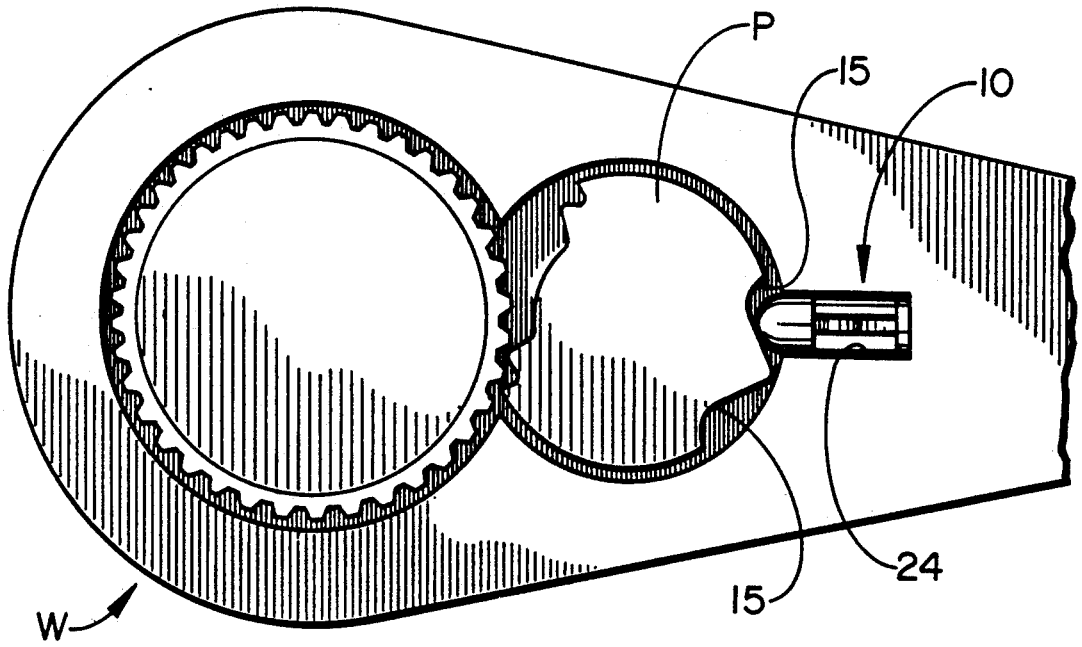
FIG. 13 is a top plan view showing the detent means of the present invention engaging another pocket in the pawl.
Figures 14, 14A, 14B, 14C, 14D, 14E:
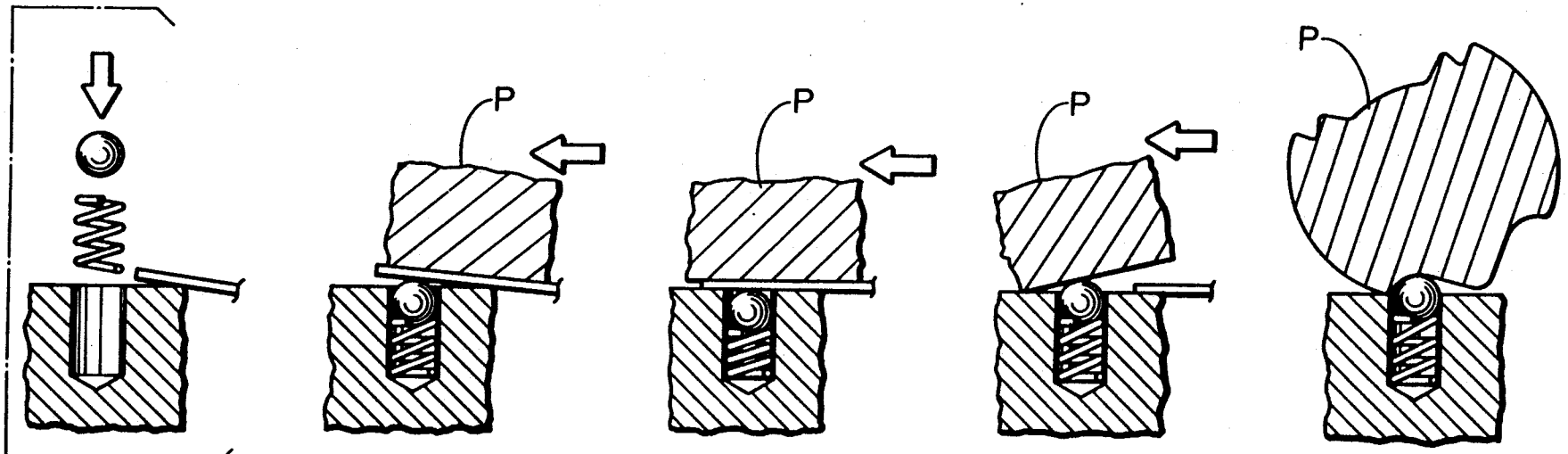
FIG. 14 PRIOR ART
FIGS. 14 14A-14E are a sequence of cross-section views of the prior art showing installation of the pawl.

A typical use of the detent means 10 is shown in FIG. 8. In a ratchet wrench W, the opening to receive the pawl usually has a blind end bore 24 formed therein, the bore being oriented toward the handle of the wrench. The detent means 10 is disposed in this bore 24 and functions to engage, alternately, the two pocket means in the pawl to retain the pawl in position for directional ratcheting of the drive member. The detent means 10 of the present invention is easily and simply disposed in the blind bore 24, the closed end of the bore serving as a stop means to contact the foot 11 of the detent means 10. FIG. 9 shows the prior art in which a spring and ball are commonly used to serve as a detent means. FIGS. 10 and 11 further show the disposition of the detent means 10 of the present invention in a ratchet wrench W as compared to the prior art. These figures show use of the detent means 10 both to engage the pocket 15 in the pawl P and to engage a socket S on the tang T of the drive member. The clearance between the detent means 10 and the walls of the bore 24 has been exaggerated for visibility. FIGS. 12 and 13 further show the engagement of the detent means 10 alternately in the adjacent pockets 15 of the pawl P as the pawl P is moved to change the direction of rotation of the drive means. Assembly of the wrench of the prior art is more labor intensive since the two components, ball and spring, must be properly oriented and the resiliency of the spring must be overcome during assembly. Further, for repair and/or replacement of the pawl or the drive member of the wrench, the ball and/or the spring are frequently lost and require replacement, adding to component and labor costs.

In the prior art, in order to install a pawl P, a special tool is inserted between the pawl and the body of the wrench to depress the ball of the detent means against the resiliency of the spring. The tool retains the detent means within the bore so that the pawl can be slid into of the wrench (FIGS. 14A–14E). If care is not taken, the tool may be displaced from the opening to the bore and the spring and ball are vigorously ejected from the wrench. For removal of the pawl in the ratchet wrench, the reverse of these steps is required employing the special tool.

Figure 15C:
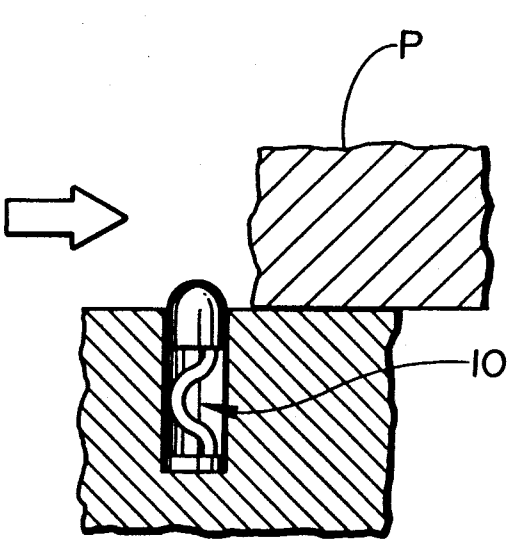
FIGS. 15A-15C are a sequence of cross-section views of he present invention showing removal of the pawl.
Figure 15B:
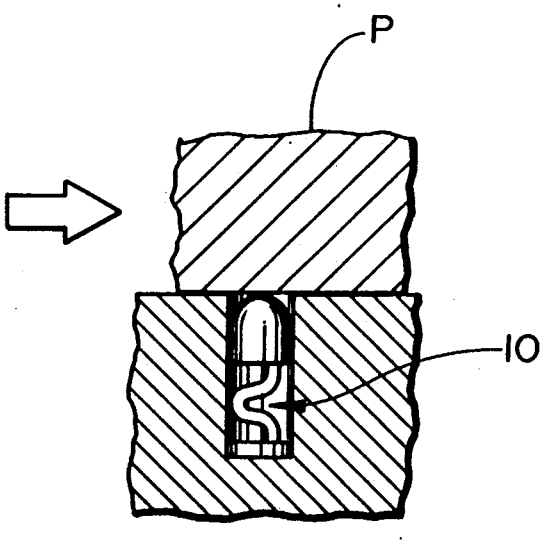
Figure 15A:
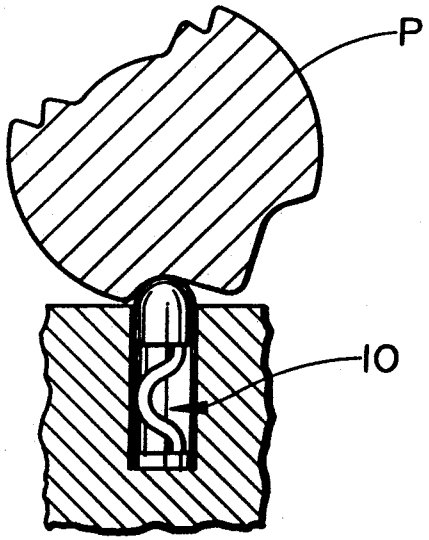

The detent means 10 of the present invention does not require any special tooling because the present invention does not have the stored kinetic energy of a compressed spring. As shown in FIGS. 15A–15C, the pawl p is simply slid away from the bore and removed for replacement and/or repair. The single unit detent means 10 is not expelled from the bore but can be removed whenever desired.

Figure 16:
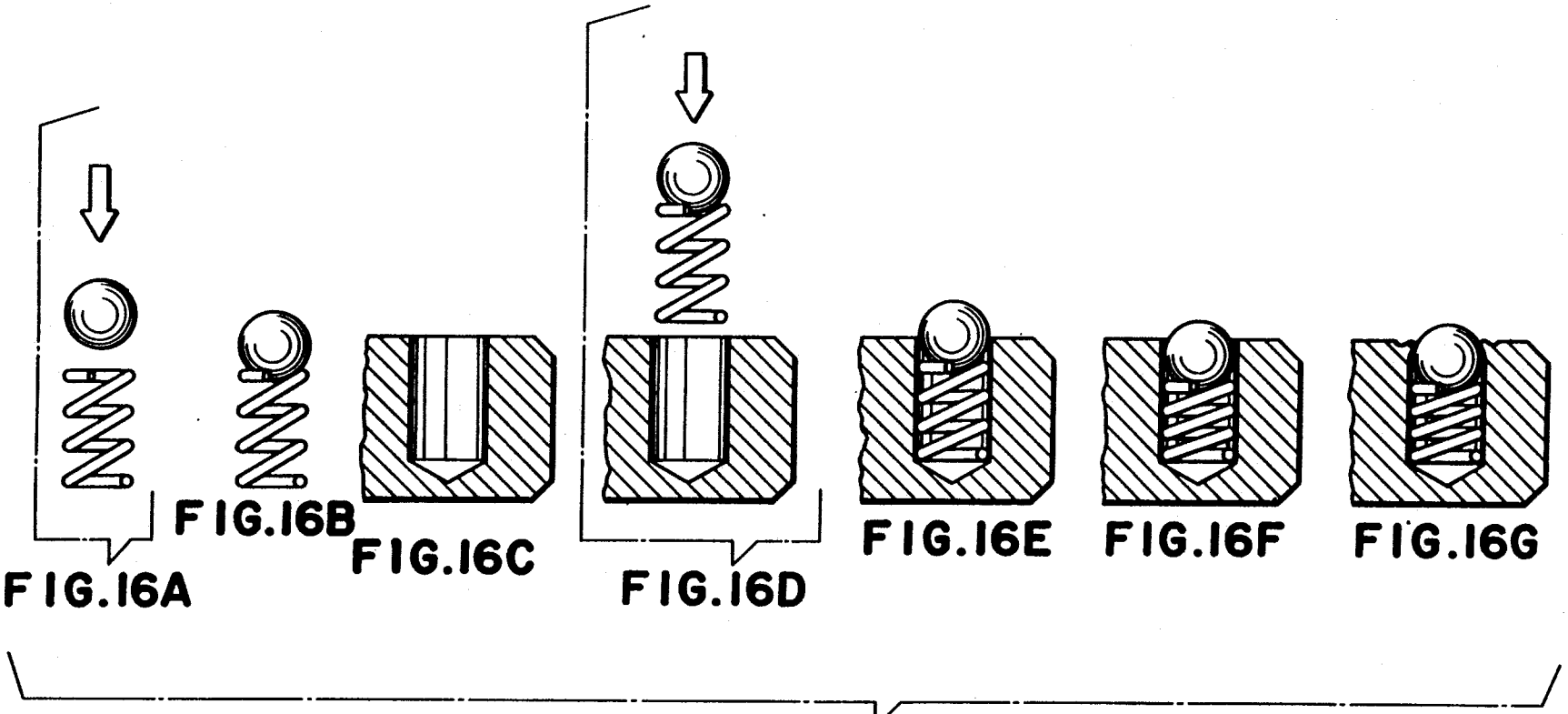
FIG. 16 PRIOR ART
Figure 17D:
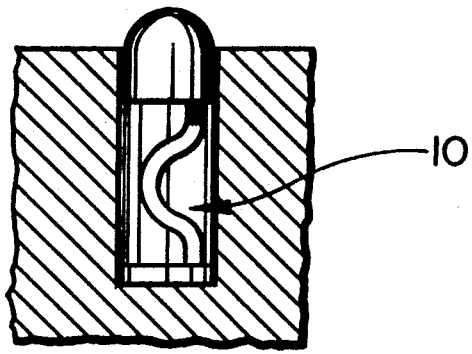
FIGS. 17A-17D are a sequence of cross-section views showing placement of the detent means of the present invention in the bore.
Figure 17C:
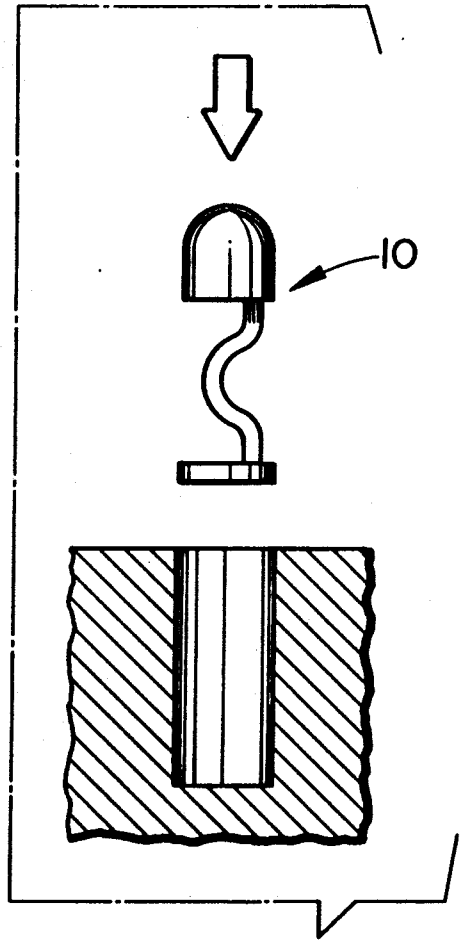
Figure 17B:
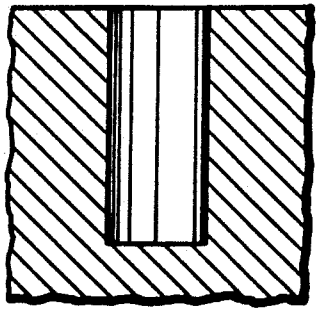
Figure 17A:
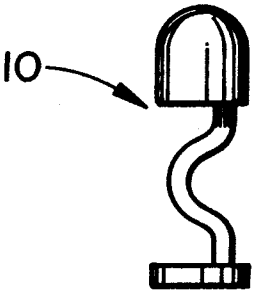

Similarly, as shown in FIGS. 16A–16G, the assembly of the spring and ball detent means of the prior art require a multitude of steps. Furthermore, in order to securely mount the spring and ball detent of the prior art in the bore, a staking operation is required after the detent means has been disposed in the bore. This is an additional assembly step to form a lip on the tang about the ball of the detent means so that the diameter of the bore is made slightly smaller than the diameter of the ball, thus preventing the spring from urging the ball completely out of the bore (FIG. 16G). The detent means 10 of the present invention does not require such a staking operation, adding to the efficiency of use of the detent means 10 with resulting savings in labor and assembly costs(FIGS. 17A–17D). The detent means 10 of the present invention may be retained in the bore by an interference fit of the foot 11 of the detent means 10 as will be described.

Figure 18:
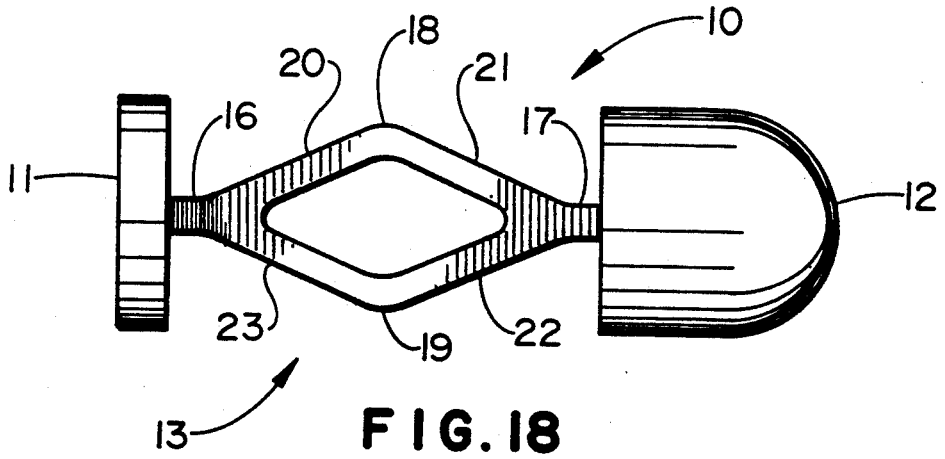
FIG. 18 is a side view of a alternate embodiment of the detent means of the present invention.
Figure 19:
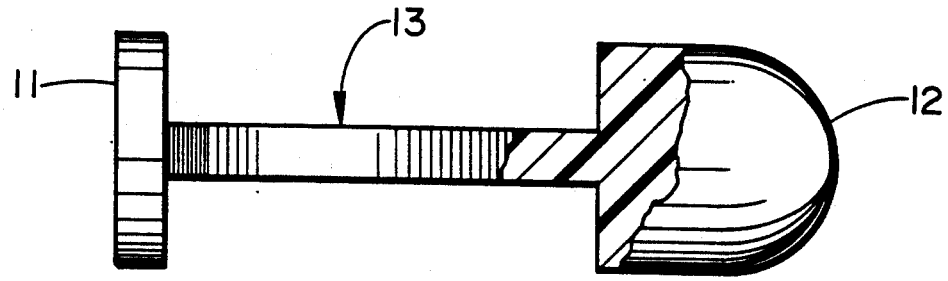
FIG. 19 is a top plan view of the embodiment of FIG. 18.

An alternate embodiment of the detent means 10 is shown in FIGS. 18 and 19. The connecting member 13 between the foot 11 and the head 12 is substantially flat, having a diamond shape. The diamond shape has a first corner 16 and an opposite second corner 17 on a first axis. A third corner 18 and an opposite fourth corner 19 are on the second axis, the axes being transverse to one another. The first axis extends between the foot 11 and the head 12 of the detent means 10. The first corner 16 is connected to the foot 11 and the second corner 17 is connected to the head 12 of the detent means 10. The diamond shape further has arm 20 between the first corner 16 and the third corner 18, arm 21 between the third corner 18 and the second corner 17, arm 22 between the second corner 17 and the fourth corner 19 and arm 23 between the fourth corner 19 and the first corner 16. When a force is applied across the ends 11, 12 of the detent means such as occurs when the pawl in the ratchet wrench is moved or the socket is placed on the ratchet wrench, the length of the first axis is reduced. This is due to movement of the ends 11, 12 towards one another. This movement is facilitated by flexing of the arms 21–24 of the diamond shaped connecting member 13. The arms 21–24 may bow inwardly toward one another or outwardly away from one another as desired. The recovery of the arms to their initial position provides a resilient capability to the connecting member 13.

Figure 20:
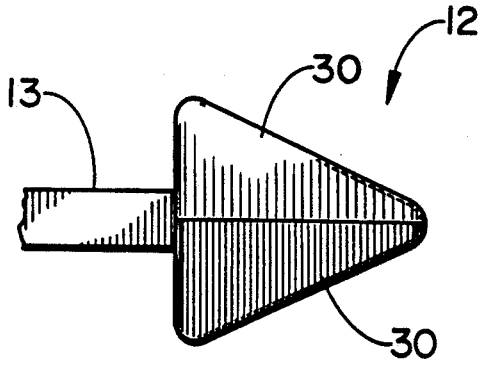
FIG. 20 is a side view of the head of the detent means of the present invention in an alternate embodiment having sloping sides on the head thereof.
Figure 21:
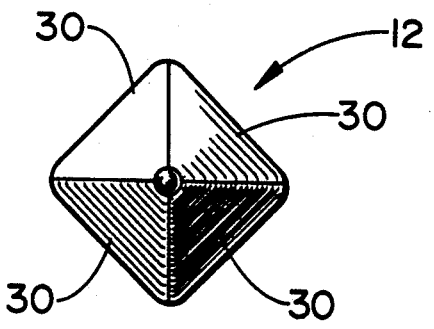
FIG. 21 is an end view of FIG. 20.

The head 12 of the detent means 10, preferably is hemispherical in shape, however, other configurations may be used. For example, FIGS. 20–21 show an alternate embodiment in which the sides 30 of the head 12 are a multiple of flattened sloping portions. Although four (4) sloping sides are shown, any desired number may be used. This configuration prevents rotation of the detent means 10 during joining and disengaging of the members in the situation where non-rotation is desired. The shape of the head 12 may be selected depending upon the application for the detent means 10.

Figure 22:
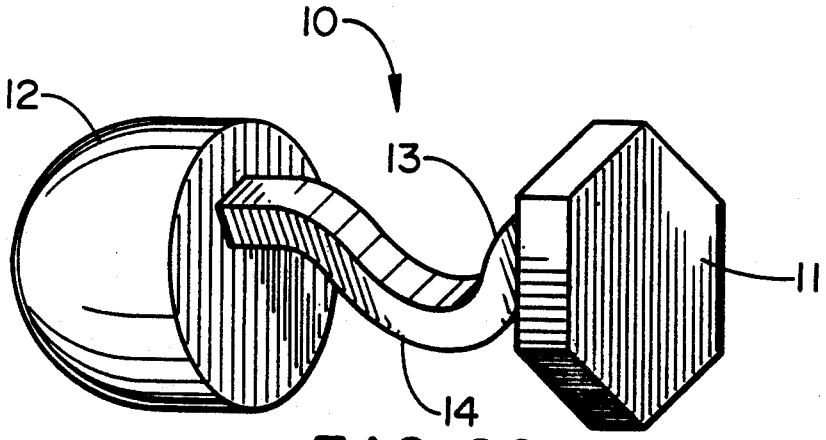
FIG. 22 is a perspective view of a alternate embodiment of the present invention having a non-circular shaped foot.
Figure 23:
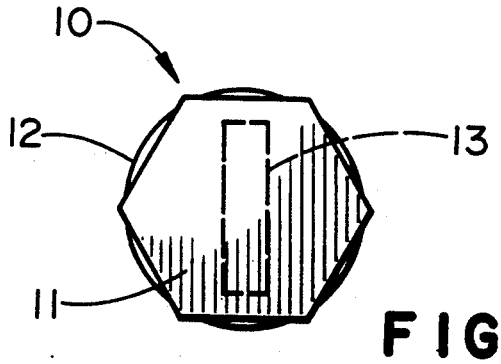
FIG. 23 is an end view of the embodiment of FIG. 22 disposed in a bore showing an interference fit.

The foot 11 of the detent means 10 may circular to cooperate with a circular bore or alternatively may have a shape which is uncooperative with (dissimilar from) the bore (FIGS. 22–23). Thus, an interference fit is provided between the foot 11 of the detent means and the circular bore such that the detent means 10 is wedged in the bore. Rotational movement of the detent means is restricted and removal of the detent means 10 from the bore is also restricted. The shape of the foot 11 may be of any desired configuration, preferably polysided or ovoid, and not round, which provides an interference fit. In the event the bore is not circular, the foot 11 of the detent means 10 could be circular, but uncooperative. This embodiment is preferred when the detent means is mounted in the tang of a ratchet wrench since it more securely retains the detent means. This embodiment is not preferred for a detent means used with a pawl in a ratchet wrench since it is sometimes necessary to remove or replace the detent means and an interference fit would make the removal of the detent means very difficult.

Figure 24:
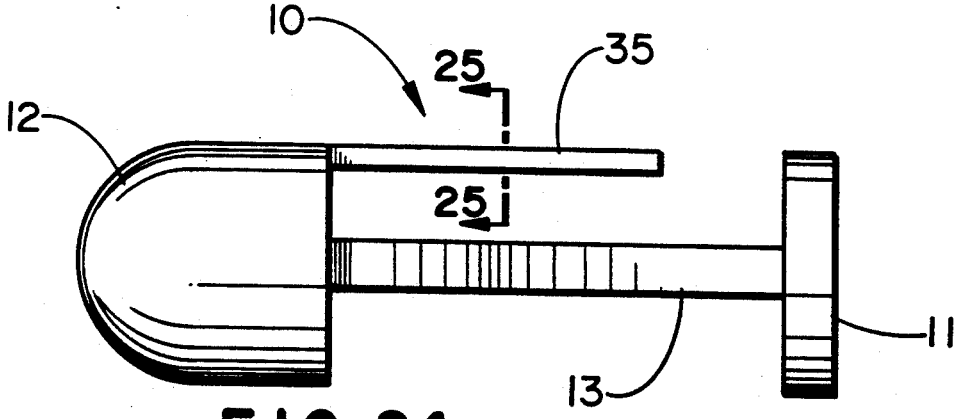
FIG. 24 is a top view showing a limiting member formed on the head of the detent means of the present invention.
Figure 25:
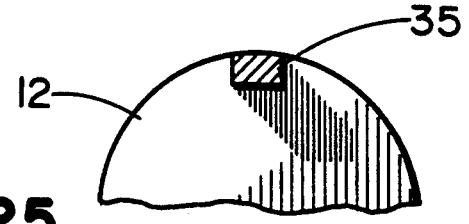
FIG. 25 is a cross-section view taken along the lines 25—25 of FIG. 24.
Figure 26:
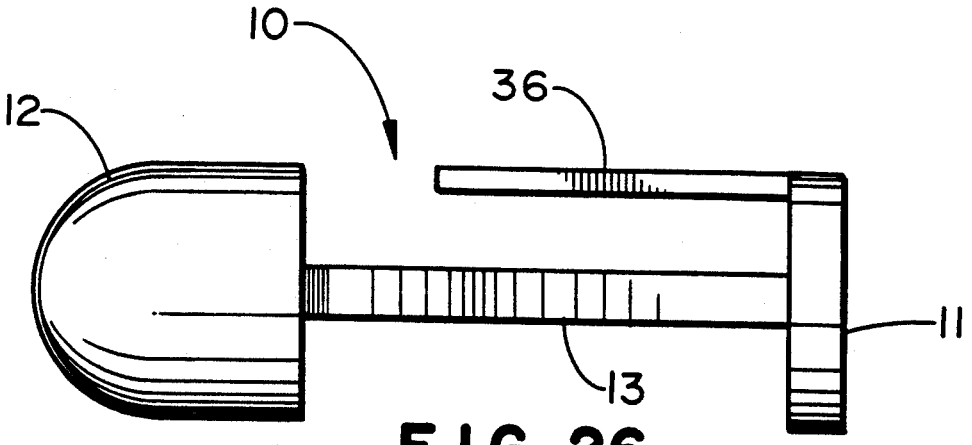
FIG. 26 is a top view showing a limiting member formed on the foot of the detent means of the present invention.
Figure 27:
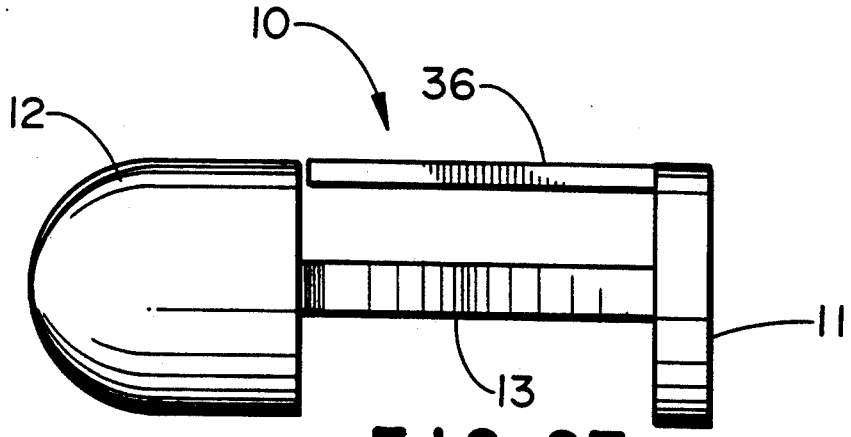
FIG. 27 is a top view showing the limiting member of FIG. 26 contacting the head of the detent mean of the present invention.
Figure 28A:
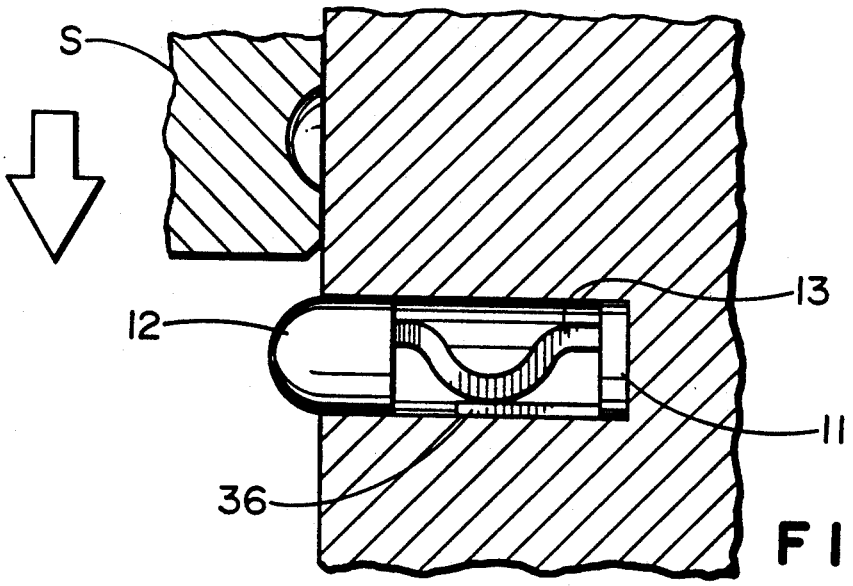
FIGS. 28A-28C is a sequence of cross-section views showing the detent means of FIG. 26 in the bore.
Figure 28B:
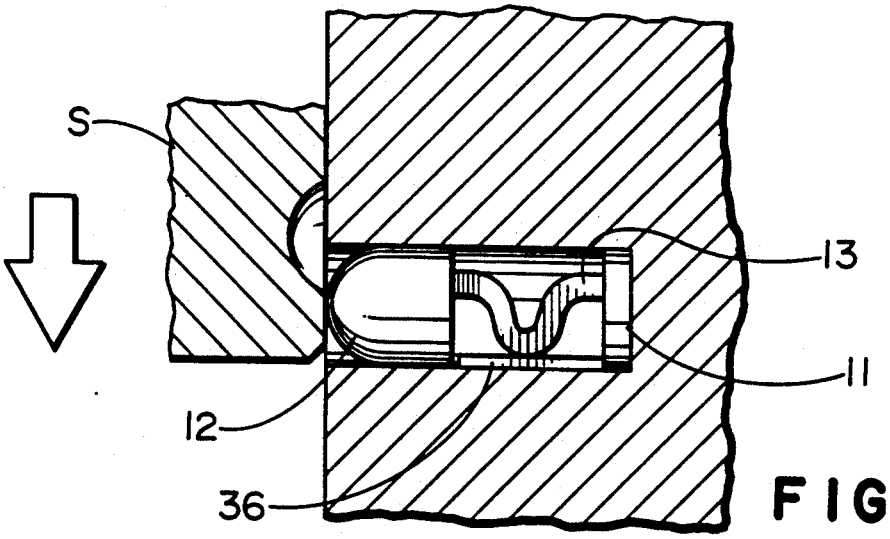
Figure 28C:
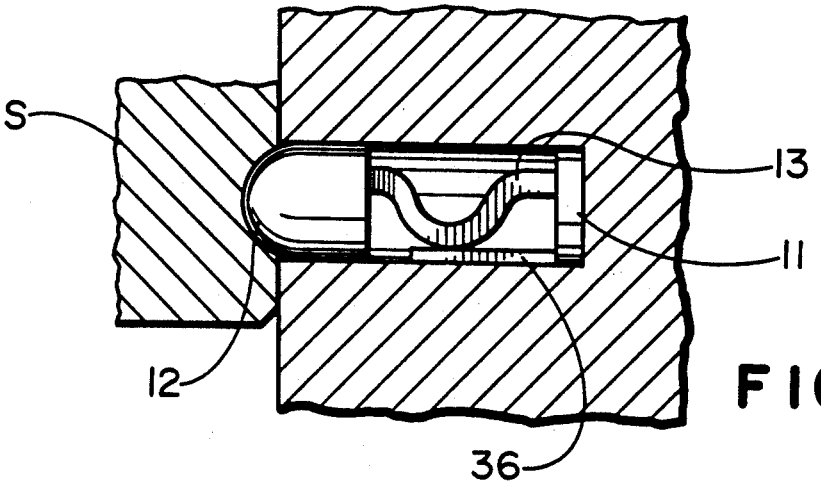

In another alternate embodiment, at least one limiting member is formed on the detent means 10. As shown in FIGS. 24–25, the limiting member 35 may be formed on the head 12 as an arm extending toward the foot 11. The at least one limiting member 36 may be formed on the foot 11 of the detent means 10 as a leg extending toward the head 12 (FIG. 26). The function of the limiting member 36 is the same as when the limiting member 35 is formed on the head 12 of the detent means 10. The limiting member 35 has a length which is determined by the extent of compression desired in the detent means 10. When a force is applied across the detent means 10, as in the situation where the detent means 10 is disposed in a bore with the foot Il in contact with a stop means, and pressure is applied to the head 12, the detent means 10 is compressed (FIG. 27). The connecting member 13 is flexed. As the detent means 10 is compressed, the limiting member 35 is brought close to the head 12 until contact is made with the head 12 (FIGS. 28A–28C). The detent means 10 is thus limited in compressibility, the extent of compressibility being determined by the space between the limiting member 35, 36 and the foot 11 or the head 12 respectively. If limiting member 35 is comparatively shorter, the detent means may be compressed to a greater extent and if the limiting member 35 is larger, the extent of compression of the detent means 10 is reduced. In the absence of a limiting member, it is possible to compress the detent means 10 to such an extent that the connecting member 13 could contact the walls of the bore and damage the connecting member 13.

Figure 29:
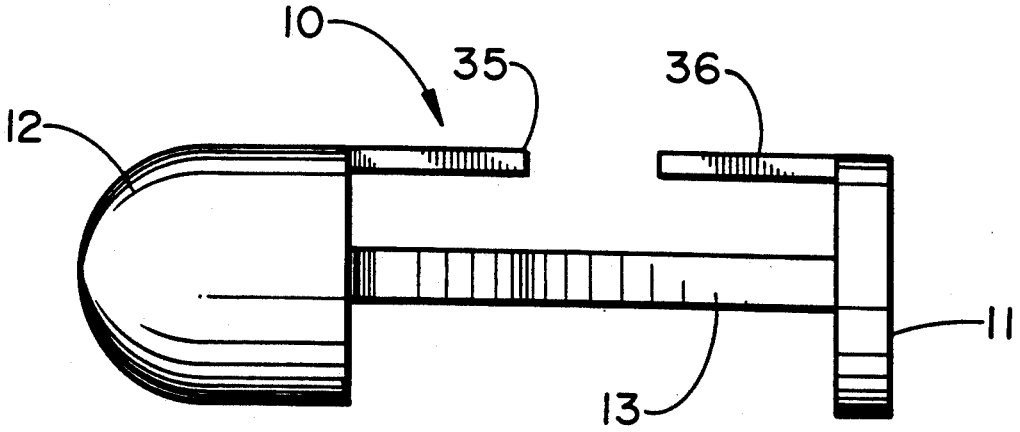
FIG. 29 is a top view showing limiting members formed on both the head and the foot of the detent means of the present invention.

The limiting members may be formed as an arm 35 on the head 12 and a leg 36 on foot 11 of the detent means 10 (FIG. 29). The space between the limiting members (arm 35 and leg 36) is the determining facto for the extent of compressibility of the detent means 10.

The limiting members 35, 36 are preferably formed substantially parallel to the connecting member to assure positive contact between the limiting members 35, 36 and the respective foot 11, head 12 or other limiting members 36, 35, depending upon which embodiment is utilized. Furthermore, the limiting member may be disposed on either side of the connecting member 13 or may be a plurality of limiting members 35, 36 disposed on both sides of the connecting member. In addition, the limiting member 35, 36 may be a sleeve or partial sleeve about the connecting member 13.

Figure 30:
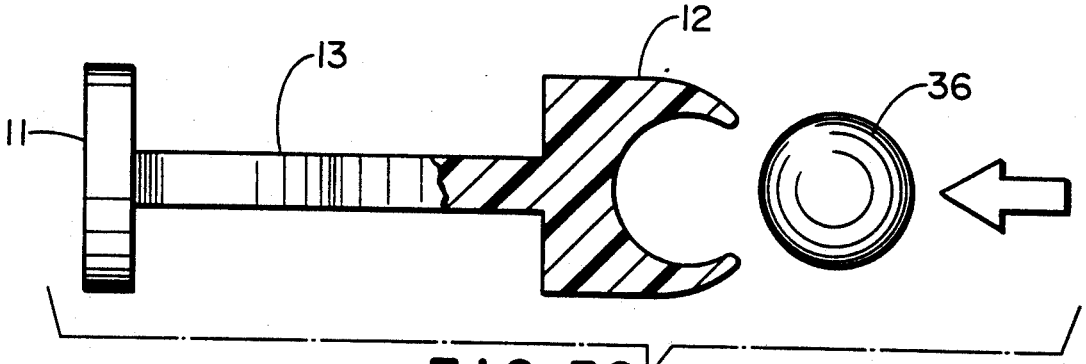
FIGS. 30-32 are top views in partial cross section, of the detent means of the present invention showing a ball being mounted in an opening on the head thereof.
Figure 31:
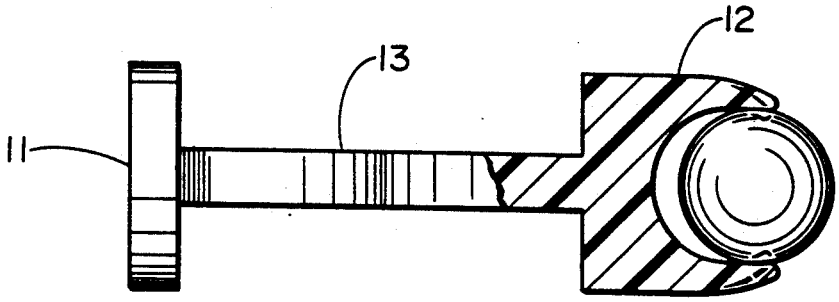
Figure 32:
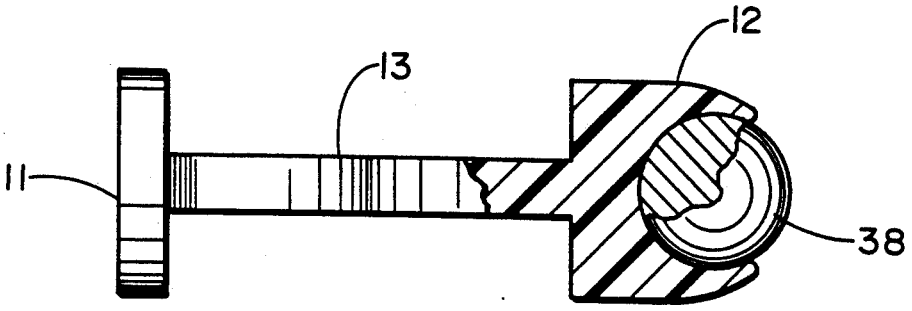

In certain instances, it may be desirable to have a dissimilar material mounted in the head 12 of the detent means 10. FIGS. 30–32 are top views of the detent means 12 showing a ball 38 being mounted therein. The ball 38 may be rotatably mounted if desired. Also, the ball 38 may be formed of any desired material such as plastic, metal, ceramic, etc. Thus, for special purposes, it may be desirable to have a hardened head surface on the detent means 10. This embodiment would be preferred when the detent means is mounted in the tang of a ratchet wrench to connect with a socket. Such a configuration would be very useful due to the frequent connection and disconnection of the socket with sharp edges and the dirt and abrasive substances which are often encountered. Alternately, the dissimilar material may be a polymeric substance which has lubricant type properties to facilitate ease of detent action.

Figure 33A:
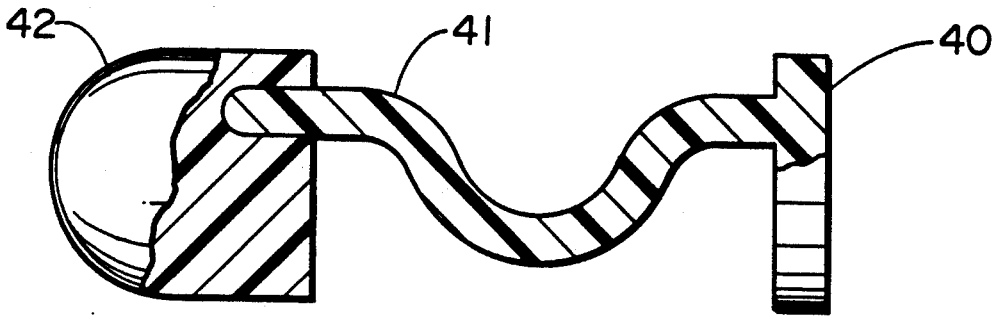
FIGS. 33A-33B are side views, in partial cross section, of a two-piece detent means of the present invention.
Figure 33B:
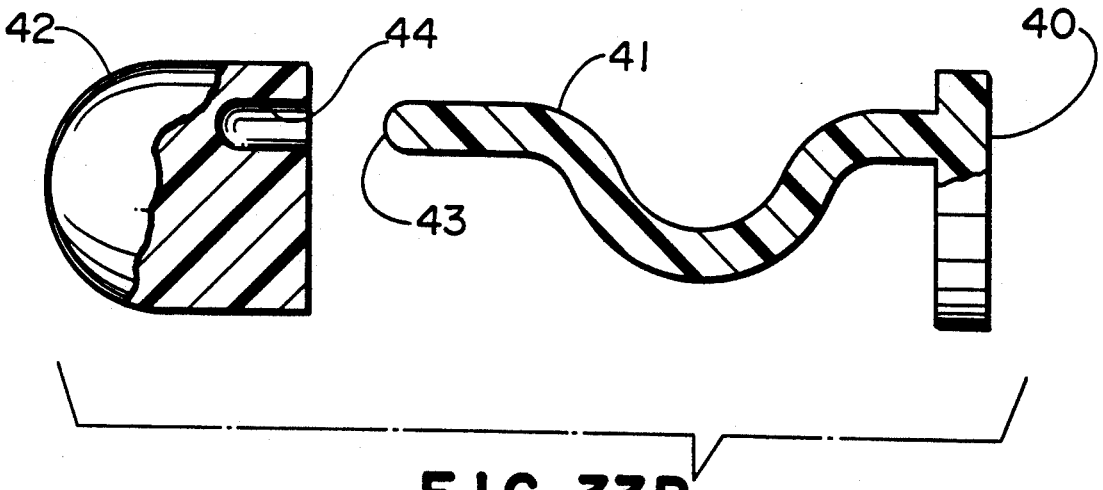

Although a one-piece detent means has the advantages herein disclosed, the detent means may be formed from two pieces (FIGS. 33A–33B). One piece includes the first end (foot) 10 and the connecting member 41 and the second piece is the second end (head) 42. An opening 43 is formed in the head 42 to receive the connecting member 41. Preferably, the means of receiving the connecting member 41 is a positive locking means to securely hold the pieces together. The securing means may be a ringing tapered end 43 on the connecting member 41 which is received in a cooperating opening 44 in the head 42 of the detent means 10. This configuration, after compression of the detent means 10, provides a secure fitting which is difficult to separate. Other securing means may be a hook and bar, a ridge and groove or any other type of cooperating connection known to persons skilled in the art. Alternately, the one piece may be the head 42 and the connecting member 41, with an opening in the foot 40 to receive the connecting member 41. The two piece detent means may be more useful in certain circumstances but would not provide all the advantages of reduced costs of production and assembly.

It may be desirable under special circumstances to provide a foot 11 formed from magnetic materials to hold the detent means 10 in the bore. Also, it may be desirable to form the head 12 and the foot 11 of different materials and have the connecting member 13 formed of the resilient material as described above. In this situation, considerations of hardness, brittleness, wear resistance, compatibility etc. are factors which would govern the selection of the materials from which the head 12 and foot 11 are formed. These considerations might cause the present invention to be formed of three components, a head 12, a foot 11 and a connecting member 13 therebetween. In all of these embodiments, the detent means 10 is a self contained device, easily preassembled, which reduces assembly and reassembly costs of a tool such as a ratchet wrench.

Accordingly, it can be appreciated that a simple, inexpensive and easily manufactured detent means is disclosed herein. For installation in a tool, all that is required is for the detent means of the present invention to be inserted in the bore. No special tools are required and no ball exists which can be lost or propelled at the operator to cause injury. The detent means of the present invention does not have the stored kinetic energy of a spring as is found in the prior art so that these problems are not encountered. The detent means may be easily installed and removed from a device such as a tool with minimal labor costs and time. The detent means is very durable and efficient.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A one-piece detent means in combination with a ratchet wrench comprising a substantially flat foot, a substantially hemispherical head having a rounded end and a flat end and a resilient connecting member therebetween, wherein the foot may be disposed against a stop means in a bore in the ratchet wrench, the head being slidably guided in the bore wherein lateral movement is prevented, the connecting member urging the rounded end of the head partially outwardly from the bore, the connecting member being a shaft having a first end connected perpendicularly to the foot of the detent means, a second end, connected perpendicularly to the flat end of the head of the detent means and at least one bight portion between the foot and the head, the connecting member providing a resiliency when a force is applied against the head of the detent means, wherein the detent means is compressed and the head of the detent means is retracted and confined within the bore.

2. A detent means for mounting in a bore formed in one member, the detent means being used in joining or releasing another member to the one member, the detent means being one piece comprising a head, a foot and a resilient connecting member therebetween, wherein the foot may be disposed against a stop means and the connecting member urging the head outwardly from the bore, the connecting member providing an inherent resiliency when a force is applied against the head of the detent means, wherein the connecting member has a substantially flat, diamond shape, having a first axis and a second axis, the axes being transverse to one another, the first axis having a length, a first corner and an opposite second corner being on the first axis, a third corner and an opposite fourth corner being on the second axis, said first corner being connected to the foot of the detent means, said second corner being connected to the head of the detent means, wherein the length of its first axis of the diamond shape is reduced, providing resiliency when a force is applied to the head of the detent means.

3. The detent means of claim 1, wherein the foot has a shape which is dissimilar from the bore providing an interference fit such that the detent means may be wedged in the bore, restricting rotational movement of the detent means within the bore and restricting removal of the detent means from the bore.

4. The detent means of claim 1, further comprising at least one limiting member being formed thereon wherein compression of the connecting member is controlled to a desired extent.

5. The detent means of claim 4, wherein the at least one limiting member is an arm having a length, the arm being formed on the head, the arm extending toward the foot forming a space having a length between the arm and the foot, the arm being disposed on an axis substantially parallel to the longitudinal axis of the connecting member, wherein, when the force is applied to the head of the detent means, the connecting member is compressed until the arm on the head contacts the foot of the detent means, the extent of the compression being determined by the length of the space between the arm and the foot.

6. The detent means of claim 4, wherein the at least one limiting member is a leg having a length, the leg being formed on the foot, the leg extending toward the head forming a space having a length between the leg and the head, the leg being disposed on an axis substantially parallel to the longitudinal axis of the connecting member, wherein, when the force is applied to the head of the detent means, the connecting member is compressed until the leg on the foot contacts the head of the detent means, the extent of compression being determined by the length of the space between the leg and the head.

7. The detent means of claim 4, wherein a first limiting member is formed on the head and a second limiting member is formed on the foot of the detent means, the limiting members being disposed on an axis substantially parallel to the longitudinal axis of the connecting member, the limiting members extending toward one another and forming a space having a length between the limiting members, wherein when force is applied to the detent means, the connecting member is compressed such that the first and second limiting members contact one another, the extent of the compression being determined by the length of the space between the limiting members.

8. The detent means of claim 1, wherein the ratchet wrench has a head portion, a pawl mounted in the head portion, the pawl having at least one pocket formed therein, and the bore formed in the ratchet wrench being in communication with the at least one pocket formed in the pawl, the detent means being disposed in the bore in the ratchet wrench wherein the detent means may be received in the at least one pocket in the pawl to position the pawl as desired.

9. The detent means of claim 1, wherein the ratchet wrench has a drive tang, the drive tang having a transverse bore therein, the detent means being disposed in the bore in the drive tang wherein the detent means may be received in an opening in a socket to join the socket to, or release the socket from, the drive tang, as desired.

10. The combination of claim 1, further including means for retaining the detent member within the bore.

11. The combination of claim 10, wherein the means for retaining the detent means within the bore comprises a foot press-fitted within the bore.

12. The combination of claim 1, wherein the means for retaining the detent means within the bore comprises the opening in the front end of the bore being staked over the head of the detent means.

13. A one-piece detent means for use in a wrench comprising a foot means, an enlarged head and a resilient connecting member in a plane therebetween, wherein the foot means may be disposed against a stop means in a bore in the ratchet wrench, the connecting member being compressible between the head and the foot means and urging the head partially outwardly from the bore, the connecting member being a shaft having a first end connected perpendicularly to the foot means of the detent means, a second end connected perpendicularly to the head of the detent means, the detent means further comprising at least one limiting means being disposed between the foot means and the head, the lease one limiting member being in a plane parallel to the plane of the connecting member and at least one limiting means limiting the compression of the connecting member.

14. The detent means of claim 13, wherein the least one limiting member is an arm having a length, the arm being formed on the head, the arm extending toward the foot means forming a space having a length between the arm and the foot means, wherein, when the force is applied to the head of the detent means, the connecting member is compressed until the arm of the head contacts the foot means of the detent means, the extent of the compression being determined by the length of the space between the arm and the foot means.

15. The detent means of claim 13, wherein the at least one limiting member is a leg having a length, the leg being formed on the foot means, the leg extending toward the head forming a space having a length between the leg and the head, wherein, when the force is applied to the head of the detent means, the connecting member is compressed until the leg on the foot means contacts the head of the detent means, the extent of compression being determined by the length of the space between the leg and the head.

16. The detent means of claim 13, wherein a first limiting member is formed on the head and a second limiting member is formed on the foot means of the detent means, the limiting members extending toward one another and forming a space having a length between the limiting members, wherein when force is applied to the detent member, the connecting member is compressed such that the first and second limiting members contact one another, the extent of the compression being determined by the length of the space between the limiting members.

* * * * *